US005669732A

United States Patent [19]

Truitt

[11] Patent Number: 5,669,732

[45] Date of Patent: Sep. 23, 1997

[54] SELF-CLOSING INTERLOCKING SANDBAGS AND PROCESS FOR ERECTING DAMS THEREFROM

[76] Inventor: Willie W. Truitt, 7402 Fire Tower Rd., Zuni, Va. 23669

[21] Appl. No.: 460,789

[22] Filed: Jun. 19, 1995

[51] Int. Cl.[6] ..... E02B 3/12

[52] U.S. Cl. ..... 405/20; 405/18; 405/19

[58] Field of Search ..... 405/19, 20, 15, 405/18

[56] References Cited

U.S. PATENT DOCUMENTS

| | | | |
|---|---|---|---|
| 172,039 | 1/1876 | Lazarevitch | 383/6 |
| 2,047,197 | 3/1936 | Fordyce | 405/19 |
| 3,806,025 | 4/1974 | Marshall | 383/49 |
| 3,886,751 | 6/1975 | Porraz Jiminez Labora | 405/15 X |
| 3,957,098 | 5/1976 | Hepworth et al. | 405/19 X |
| 3,992,832 | 11/1976 | Dicker | 405/15 X |
| 4,449,847 | 5/1984 | Scales et al. | 405/19 |
| 4,592,675 | 6/1986 | Scales et al. | 405/19 |
| 4,690,585 | 9/1987 | Holmberg | 405/19 |
| 5,120,138 | 6/1992 | Midgley et al. | 383/7 |
| 5,176,452 | 1/1993 | Stern | 383/43 |

*Primary Examiner*—Tamara L. Graysay
*Assistant Examiner*—Tara L. Mayo
*Attorney, Agent, or Firm*—Jerome J. Norris

[57] ABSTRACT

A bag that self-closes from pressure of material insertable into the bag comprising (A) an openable overlapping elastic structure in which an innermost elastic material is disposed to completely cover an opening in the bag; and (B) an outermost elastic material disposed to completely overlap the innermost elastic material.

9 Claims, 2 Drawing Sheets

SELF-CLOSING INTERLOCKING SANDBAGS AND PROCESS FOR ERECTING DAMS THEREFROM

BACKGROUND OF THE INVENTION

1. Field of the Invention

The present invention relates generally to sandbags, which when filled with sand or other suitable grainy materials will self-close by virtue of the force exerted when the bags are substantially full. In particular, the present invention relates to sandbags of configurations, having joints capable of interlocking with each other to form a barrier or dam structure to restrict or confine the rush of overflowing bodies of water, to prevent flooding of areas inside the boundaries of the barrier or dam structure. Disclosure Document No. 335765 filed on Jul. 29, 1993 discloses concepts of the sandbags.

2. Description of the Prior Art

At present, sandbags for controlling overflowing bodies of water and the like have typical dimensions of 14"×26", and have openings that are filled with sand or grainy materials by hand or shovel. After filling the bags with sand or other grainy materials, the bag openings are tied at the top with a piece of cord to hold the sand or other grainy materials within. This method of filling and tying the bags is inefficient, time consuming, and very labor intensive.

U.S. Pat. No. 172,039 discloses a grain-bag having a funnel-shaped part above the mouth of the bag, and a mouth which is made narrower by closed shoulders on each side of the funnel. After the bag is filled with grain, the funnel is reversed by hand and forced into the grain by hand, thereby pushing it through the mouth of the center of the bag, in order to close this non-self closing bag and prevent the grain from coming out.

U.S. Pat. No. 5,176,452 discloses a self-closing bag having front and rear sidewalls which are interconnected at their side edges and top and bottom. In this self-closing bag, a spring strip in the form of a longitudinal slot extends from a top edge to near a bottom edge of the bag on at least one of the front and rear sidewalls. The spring strip holder is designed to accept a self-rolling spring strip having a concave top surface and convex bottom surface. The spring strip has the property of remaining straight when unrolled but self-rolling when it is slightly bent from its straight condition.

U.S. Pat. No. 5,120,138 discloses a flexible bag closure system comprising a bag and liner, in which the bag is maintained open by an attached elastic band. The elastic band is placed on either side of at least one gusset fold in an untensioned state in order to bridge the gusset. When the bag top is folded over a container rim, the elastic is stretched on the outside of the container, thereby permitting the bag to be folded flat while providing means to keep the bag open during use. The elastic is useful as a closure after use.

U.S. Pat. No. 3,806,025 discloses a stemming bag that is fillable with a non-compressible fluid and possesses a self-closing valve. The valve is formed of overlying strips of vinyl heat sealed along predetermined lines to provide a narrowed valve passage.

When there is an on-rush of overflowing waters that threaten flooding, there is a need in the sandbag art to rapidly stem the tide of these waters, by swiftly filling the bags so that they may serve as a barrier or dam. The step of having to tie the filled bag with a cord or other type of device materially slows down the process of-erecting the barrier.

If the tying step could be eliminated, precious time would be saved.

There is a need in the sandbag art to swiftly fill the sandbag without the need of tying the bag to contain its contents, and to provide a manner or means in which the bags can temporarily interlock through a temporary structural connection or joint, in order to transfer loads from one sandbag to an adjoining sandbag to offset the force from the rush of flowing bodies of water acting on the dam or barrier.

SUMMARY OF THE INVENTION

One object of the present invention is to provide sandbags having at least one joint or connection which is temporarily interlockable with the joint or connection of another sandbag, in order to form a temporary structural connection that furnishes supporting reactions and transference of loads from one sandbag to another, as a result of the shifting pressures exerted on the bags from the on-rush of flowing bodies of water.

Another object of the present invention is to provide sandbags having at least one joint or connection which is temporarily interlockable with the joint or connection of another sandbag, in order to form a temporary structural connection that furnishes supporting reactions and transference of loads from one sandbag to another according to pressures exerted by the on-rush of water, wherein, prior to utilizing the bag as a barrier, the bag is provided with self-closing means to close the bag as a result of the force of pressures from a substantially filled mass of sand or other grainy materials within the bag.

A yet further object of the invention is to provide sandbags having at least one joint or connection which is temporarily interlockable with the joint or connection of another sandbag, in order to form a temporary structural connection that furnishes supporting reactions and transference of loads from one sandbag to another upon shifting pressure from the on-rush of water on a previously self-closed filled bag, that has been filled using a pressure blower which has blown the sand or other grainy materials into the bag to affect self-closing and thereby eliminate the need for tying the bag, prior to using the bag as a dam or barrier.

In general, the self-closing interlocking sandbag of the invention is characterized by at least one opening comprising an overlapping elastic structure in which an innermost elastic material completely covers the opening through which sand or grainy materials are inserted, and an outermost elastic material which completely covers the innermost elastic material. The overlapping elastic structure of the opening may be sewn, bonded, or fixed in place by any well known means to the interior of the bag so that slight pressure from a nozzle can open the overlapping elastic structure to introduce sand. When the bag is filled with the sand or other grainy materials, pressure from the filled bag exerts itself on the innermost elastic material, which in turn closes, and prevents sand from exiting the opening, upon removal of the nozzle through which sand is placed into the bag, and the outermost elastic material resumes its normal prestressed or biased position in overlapping arrangement over the innermost elastic material.

DETAILED DESCRIPTION OF THE INVENTION

The self-closing interlocking sandbag of the invention has at least one opening comprising an overlapping elastic structure which comprises an innermost elastic material that completely covers the opening through which sand or other grainy materials may be inserted, and an outermost-elastic material that completely covers the innermost elastic material.

The overlapping elastic structure unit of the opening may be sewn, bonded, or fixed in place by any well known means, to the interior of the bag. While the overlapping elastic structure is prestressed or biased to rest in a closed position in the opening entrance, the overlapping outermost elastic material is biased so that it completely covers the innermost elastic material. Nevertheless, the unit may be opened by slight pressure from a nozzle in order to introduce sand or other grainy materials.

When the bag is filled with sand or other grainy materials, pressure from the filled bag exerts itself on the innermost elastic material, which in turn, prevents sand from exiting through the opening, upon removal of the nozzle through which sand is placed into the bag, and the outermost elastic material then resumes its normal prestressed or biased position in overlapping arrangement over the innermost elastic material.

Figure 1:
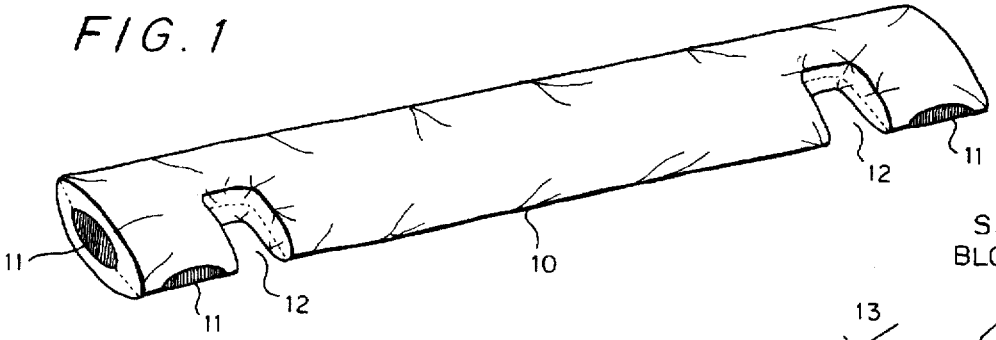
FIG. 1 is a view in perspective showing an unfilled sandbag having three overlapping elastic structures at three different positions and two joints to accommodate another sandbag, when placing the sandbags together in adjoinment to form a barrier or dam structure.

Reference is now made to FIG. 1 which depicts an unfilled sandbag 10 having three overlapping elastic structure units 11 disposed at opposite ends of the sandbag, and two slots or grooves 12 which may form the groove part of a tongue-and-groove joint to accommodate a sandbag of the invention having tongues disposed thereon to form a tongue-and-groove joint to temporarily interlock two adjoining or connecting sandbags towards erecting a dam or barrier.

Figure 2:
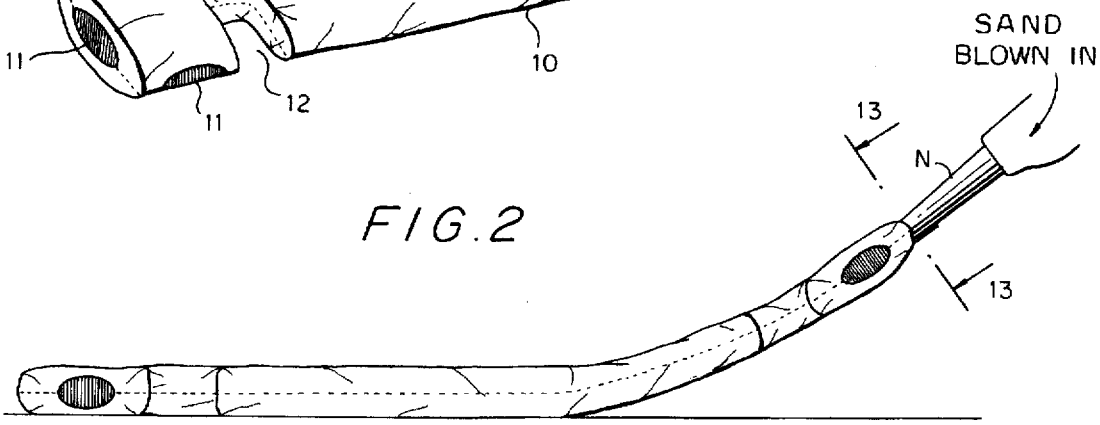
FIG. 2 is a view in perspective showing the use of a nozzle from an apparatus for blowing sand or other grainy materials into the bag from one of the overlapping elastic structures.

As can be seen from FIG. 2, the sandbag of the invention may be filled by using an apparatus containing a nozzle N to force sand into the bag.

Figure 3:
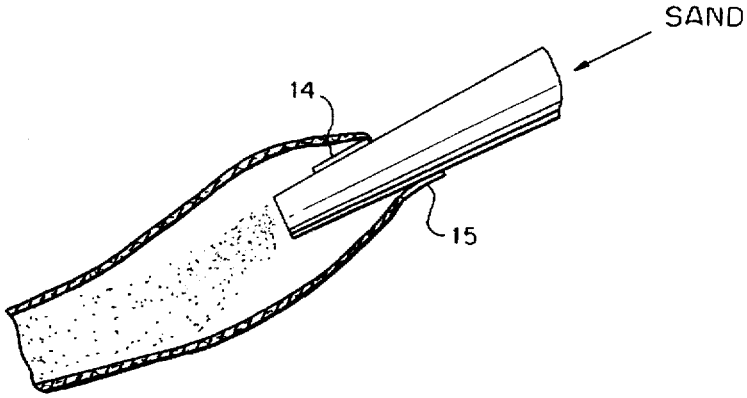
FIG. 3 is an enlarged view of the interconnected sections of the sandbag and nozzle taken along line 13,13 of FIG. 2 showing the innermost and outermost elastic materials in the open or unclosed position as the bag is being filled.
Figure 4:
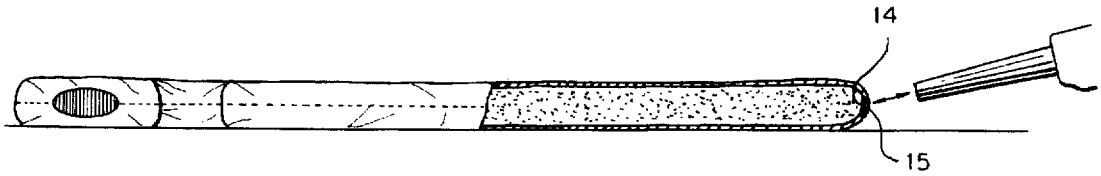
FIG. 4 is a view showing a sand-filled bag in which pressure from sand within the bag has self-closed the overlapping sections of the elastic structures of the bag.

FIG. 3 shows an enlarged view of a section taken along line 13,13 of FIG. 2, wherein the inserted nozzle forces the prestressed innermost elastic material 14 into a position approximately longitudinal to the axis of the nozzle and inside of the bag in which sand is inserted, while at the same time, the prestressed outermost elastic material is pushed or forced into a longitudinal position along the axis of the nozzle so that the outermost elastic material 15 remains exterior or outside of the sandbag.

After the sandbag is filled and the nozzle through which the sand is inserted is removed, pressure from sand within the bag exerts itself on the innermost elastic material 14 while the prestressed outermost elastic material resumes its normal position in overlapping arrangement over the innermost elastic material as a result of removing the nozzle through which sand or other grainy materials are inserted.

It has been found that, in order to completely fill the bag to its maximum capacity, the nozzle through which sand is blown should also be placed into the overlapping elastic structures at opposite ends from which the sand or other grainy materials are initially introduced, to insure that the bag is filled to its maximum capacity.

Figure 6:
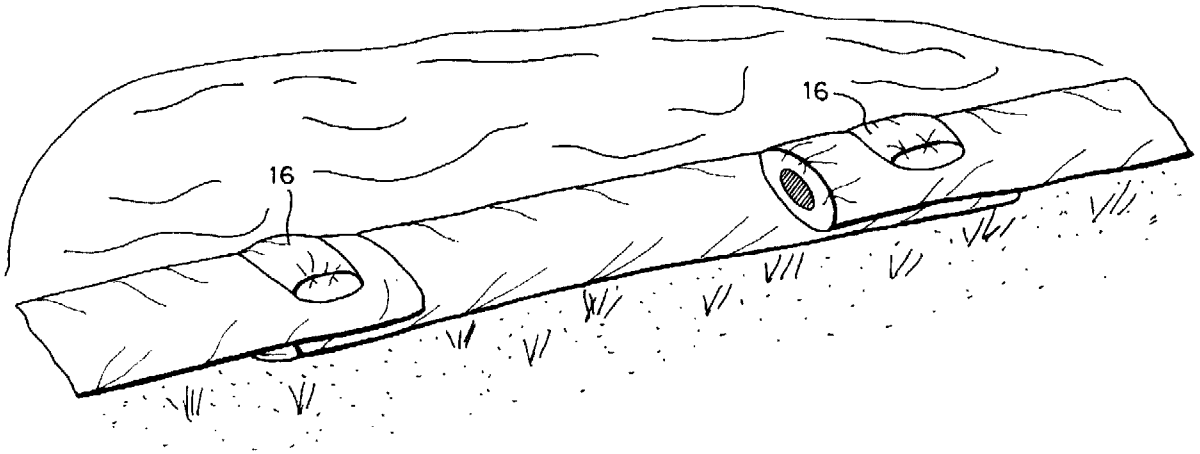
FIG. 6 is a view in perspective of filled sandbags in which the joints are temporarily interlocked to form a barrier or dam structure at the bank of a rising river.

A sandbag similar to that of FIG. 1 with tongues 16 that temporarily interlock with a groove joint as shown in FIG. 1, but comprising similar overlapping elastic structures for openings is shown by the filled Sandbags of FIG. 6, in which two sets of tongue 16 and groove joints are temporarily interlocked to form a barrier or dam at the bank of a rising river.

During an emergency situation in which there is a threat of rush of overflowing water from a river or other body of water, a plurality of sandbags may be filled simultaneously, directly at the bank of the rising river, by the use of a dump truck D to deposit sand S onto a suitable platform from which a vacuum hose VH pulls the sand or other grainy material into a blower B or other form of forced air system. From a number of outlet hoses or ducts attached to the blower, sand is forced through a plurality of nozzles directly into the sandbags of the invention in order to form a barrier or a dam structure at the bank of the rising body of water.

Figure 5:
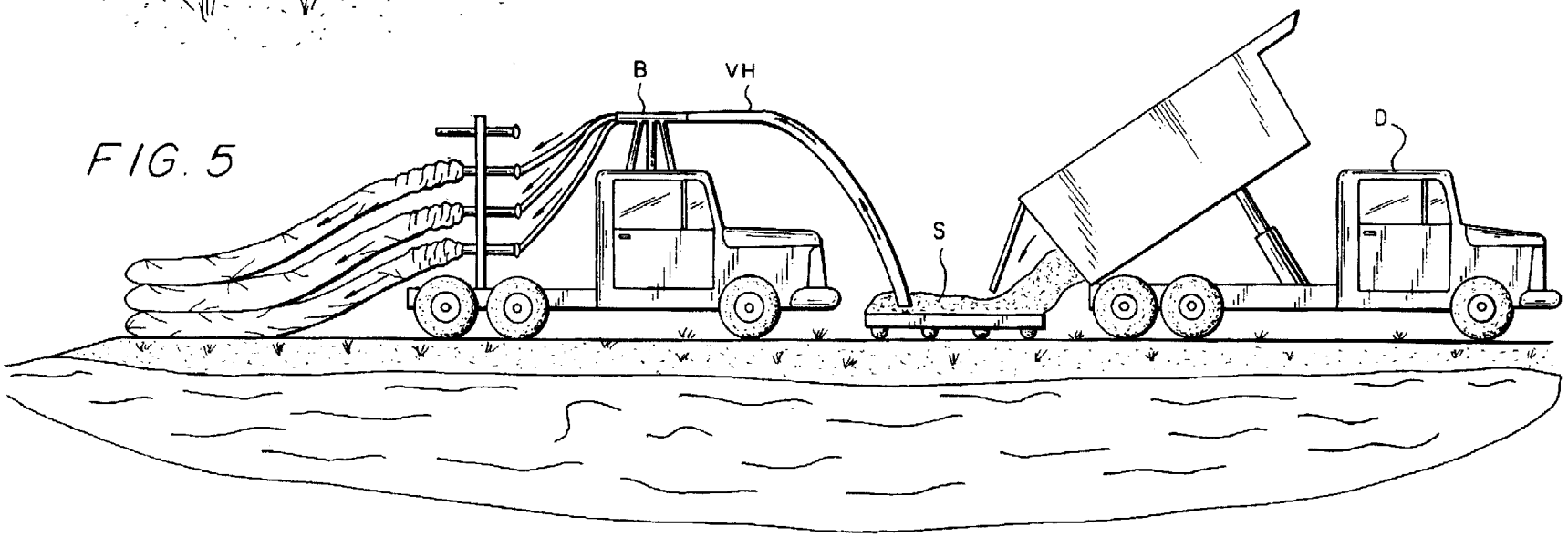
FIG. 5 is a schematic view showing a dump truck dumping sand which is pulled through a blower and forced into a plurality of the sandbags of the invention at the bank of a river about to overflow.

In the context of the invention, while a tongue-and-groove joint is preferred, any form of interlocking joints that will temporarily hold the sandbags together as a unitary structure or barrier to form a dam against rising rivers will suffice. Further, as shown in FIG. 5, the sandbags may be selectively filled from the bottom to the uppermost bag or filled simultaneously so that they are already in position on top of each other, thereby eliminating the need to physically lift the sandbags as each is filled in order to place one on top of the other to form a dam structure.

While sand is the preferred material for filling the sandbags, silt, clay, rock or gravel, may also be used, either alone or in any combination as the filling material for the sandbags.

Further, the sandbags of the invention may be used for many different types of dams: such as diversion dams to divert water from a stream; navigation dams to raise the level of a stream to increase the depth for navigation purposes; power dams to raise the level of a stream to create or concentrate hydrostatic head for power purposes; and storage dams to store water for municipal or industrial use, irrigation, flood control, river regulation, recreation, or power production. Alternatively, the sandbags of the invention may be used as a unitary structure as the dam which serves two or more purposes—or as a multiple-purpose dam.

The interlocking log sandbag of the invention is put together very much like logs, as this configuration facilitates building a dam in a manner much like building a log house, i.e. through interlocking two or more of the log-type sandbags so that they become supportive of one another and thereby create a stronger unit or dam. The sandbag may be made of jute, burlap, polypropylene or any other well known materials used in the sandbag art.

Further still, these bags may be filled on land as well as under water, and the bags can be used as molds on land and under water to form walls and barriers, when filled with cement, concrete, plaster, or mortar.

Further, the bags may be used for large or small military bunkers, that surround foxholes, or to put up a wall on a beach head to protect troops arriving from a landing craft onto a beach head during a period of strife.

Yet further, the log-type sandbags of the invention may be folded or made in accordion form so that they may expand and contract, thereby allowing them to occupy less space until use of the bags for purposes of forming a dam have become ripe.

What is claimed is:

1. A bag that self-closes from pressure of material which is insertable into said bag comprising: (A) an openable overlapping elastic structure in which a prestressed innermost elastic material is disposed to completely cover an opening in said bag; and (B) a prestressed outermost elastic material is disposed to completely overlap said innermost elastic material; said bag having at least one joint capable of forming a temporary interlock or connection with at least one joint disposed on at least an additional self-closing bag having an openable overlapping elastic structure in which an innermost elastic material is disposed to completely cover an opening in said bag and an outermost elastic material is disposed to completely overlap said innermost elastic material.

2. The bag of claim 1, wherein said joint capable of forming an interlock or connection with a joint disposed on at least one additional self-closing bag is a tongue-and-groove joint.

3. The bag of claim 2, filled with a grainy material other than sand.

4. The bag of claim 3, wherein said grainy material is selected from silt, clay, rock, gravel, or combinations thereof.

5. The bag of claim 2, filled with sand.

6. A process for erecting a dam or barrier against a rush of overflowing water from a body of water comprising forming a temporary interlock with bags having at least one joint capable of forming a temporary interlock or connection with at least one joint disposed on at least an additional self-closing bag having an openable overlapping elastic structure in which a prestressed innermost elastic material is disposed to completely cover an opening in said bag and a prestressed outermost elastic material is disposed to completely overlap said innermost elastic material to form a unitary structure, and placing the unitary structure on the bank of a rising body of water.

7. The process of claim 6, wherein said bags are filled with sand.

8. The process of claim 6, wherein said bags are filled with a grainy material other than sand.

9. The process of claim 6, wherein the self-closing bags are made of a material selected from jute, burlap, and polypropylene.

* * * * *